United States Patent [19]

McWilliams

[11] 4,350,875

[45] Sep. 21, 1982

[54] RADIANT HEATING ELEMENTS FOR SMOOTH TOP COOKERS

[75] Inventor: Joseph A. McWilliams, Droitwich, England

[73] Assignee: Micropore International Ltd., England

[21] Appl. No.: 229,999

[22] Filed: Jan. 30, 1981

[30] Foreign Application Priority Data

Feb. 1, 1980 [GB] United Kingdom ..... 8003559

[51] Int. Cl.[3] ..... H05B 3/68

[52] U.S. Cl. ..... 219/449; 219/446; 219/466; 219/458; 219/512; 337/394

[58] Field of Search ..... 219/445, 446, 448, 449, 219/452, 459, 460, 512, 466, 532, 467, 513, 464; 126/396; 337/386, 394

[56] References Cited

U.S. PATENT DOCUMENTS

| | | | |
|---|---|---|---|
| 3,277,279 | 10/1966 | Wei | 219/466 X |
| 3,317,709 | 5/1967 | Beasley | 219/449 |
| 3,710,076 | 1/1973 | Frazier | 219/449 |
| 3,909,592 | 9/1975 | Eide | 219/462 |
| 4,135,081 | 1/1979 | Fischer | 219/449 |
| 4,243,874 | 1/1981 | Fischer | 219/447 |

FOREIGN PATENT DOCUMENTS

| | | | |
|---|---|---|---|
| 760008 | 12/1933 | France | 219/466 |
| 900379 | 10/1944 | France | 219/466 |
| 865375 | 4/1961 | United Kingdom . | |
| 883154 | 11/1961 | United Kingdom . | |
| 911647 | 11/1962 | United Kingdom . | |
| 1076496 | 7/1967 | United Kingdom . | |
| 1135561 | 12/1968 | United Kingdom . | |
| 2044057 | 10/1980 | United Kingdom . | |

*Primary Examiner*—Volodymyr Y. Mayewsky
*Attorney, Agent, or Firm*—Allegretti, Newitt, Witcoff & McAndrews

[57] ABSTRACT

The invention relates to electric heater units for "smooth top" cookers which employ two or more heater elements in the same unit. It is directed particularly at the problem of monitoring the temperature of the unit and/or the "smooth top" thereover to protect against overheating. It is known to use a thermal cut-out device extending over the heater unit where a single element is used, but design problems develop when two or more elements are employed in the same unit, of which at least one element is independently energizable. According to the invention an elongate thermal cut-out device (10) extends across said one element (10) but is thermally isolated from the other element or elements. Thus, the device operates only in response to the one element. Such thermal isolation can be accomplished by shielding a portion of the device which extends across the other element or elements by means of a block of thermal insulation material, or by means of a tube of thermally conductive material which carries any heat from the other element or elements to a heat sink.

10 Claims, 4 Drawing Figures

RADIANT HEATING ELEMENTS FOR SMOOTH TOP COOKERS

BACKGROUND TO THE INVENTION

This invention relates to electric radiant heater units of the kind used in "smooth top" cookers. More particularly, it relates to such heaters which employ two or more heater elements in the same unit.

A "smooth top" cooker is one in which a smooth top normally of glass ceramic, overlies one or more generally circular electric heater elements supported on a layer of thermal and electrical insulating material such that the element is spaced from the top. In use, a utensil placed on the top over an element is heated by the transmission of heat from an element to and through the top by air convection, conduction and infra red radiation. Such elements are referred to as "radiant heaters". The insulating material substantially prevents heat being transmitted away from the element except towards the top and as the preferred materials for the top are essentially thermally non-conductive, only areas of the top which ae directly exposed to the element will be heated. In order to prevent heat being transmitted to parts of the top not covered by a utensil placed thereon, a peripheral wall of insulating material is also normally provided around the coil.

It is usual, and in some jurisdictions mandatory in radiant heaters to include a thermal cut-out device to protect both the element and the top from overheating. While it is possible to design a heater with a low watts density to obviate the need for a cut-out device, this leads to a slow cooking performance. Thus, a thermal cut-out device is desirable from both the point of view of safety and that of performance. Further, excessive temperatures can result in damage to or discoloration of the top in a smooth top cooker. For example, a glass ceramic top can discolour if the temperature at the exposed surface exceeds 600° C. (700° C. at the surface nearest the heater element or elements).

SUMMARY OF THE INVENTION

In radiant heater units which employ two or more adjacent heater elements of which one is of larger thermal capacity than any of the others, we have found that a thermal cut-out device can satisfactorily protect the unit from overheating if its response is limited to the heat generated by that larger element. However, a problem exists if the or another element also has an influence. Typical thermal cut-out devices are of elongate form, designed to extend across the heater unit, and the present invention provides an electric radiant heater unit having at least two adjacent heater elements of which at least one is energisable independently from the other or others, wherein a thermal cut-out device extends across said one element but is thermally isolated from said other element or elements such that it is operative in response only to heat generated by said one independently energisable element.

Thermal isolation of the thermal cut-out device can be achieved in a number of ways. Most simply perhaps, that portion of it which would otherwise be affected by the other element or elements is shielded by a thermal insulation material, typically in the form of a block which can be shaped to fit neatly into the heater unit. Another way is to sheath the portion of the thermal cut-out device in a thermally conductive material which transmits the heat which would otherwise influence the device away to a heat sink or to a point external of the unit.

The invention is particularly suited to heater units in which one heater element surrounds another, for example in a circular heater unit having two concentric elements. However it can also have use where two elements are located adjacent one another in the same unit where positioning of the thermal cut-out device with respect to the unit is predetermined and cannot conveniently be moved to a location contiguous with one element only.

The heater elements in units of the present invention are preferably bare coiled wires supported in a microporous thermal insulation material. Such a coiled wire may be straightened in the vicinity of the element from which the thermal cut-out device is to be isolated to reduce the amount of heat radiated therefrom which might influence the thermal cut-out device. Where the thermal cut-out device is enclosed in a block of insulation material, this facilitates the formation of the block and enables a greater thickness of material to be interposed between the thermal cut-out device and the respective element. In some embodiments, the element is discontinuous along a peripheral zone in which it is effective and in these cases, the thermal cut-out device may traverse the discontinuity.

The thermal cut-out device is normally of the differential expansion type, a suitable device comprising a quartz tube containing a length of Inconel wire, differential expansion of the tube and wire operating a switch which de-energises the entire unit. Such a device is available from Therm-o-disc Mansfield, Ohio, U.S. of America under the designation "12.T.B. Limiter".

BRIEF DESCRIPTION OF THE DRAWINGS

The invention will now be described by way of example and with reference to the accompanying drawing wherein.

DESCRIPTION OF PREFERRED EMBODIMENTS

Figure 1:
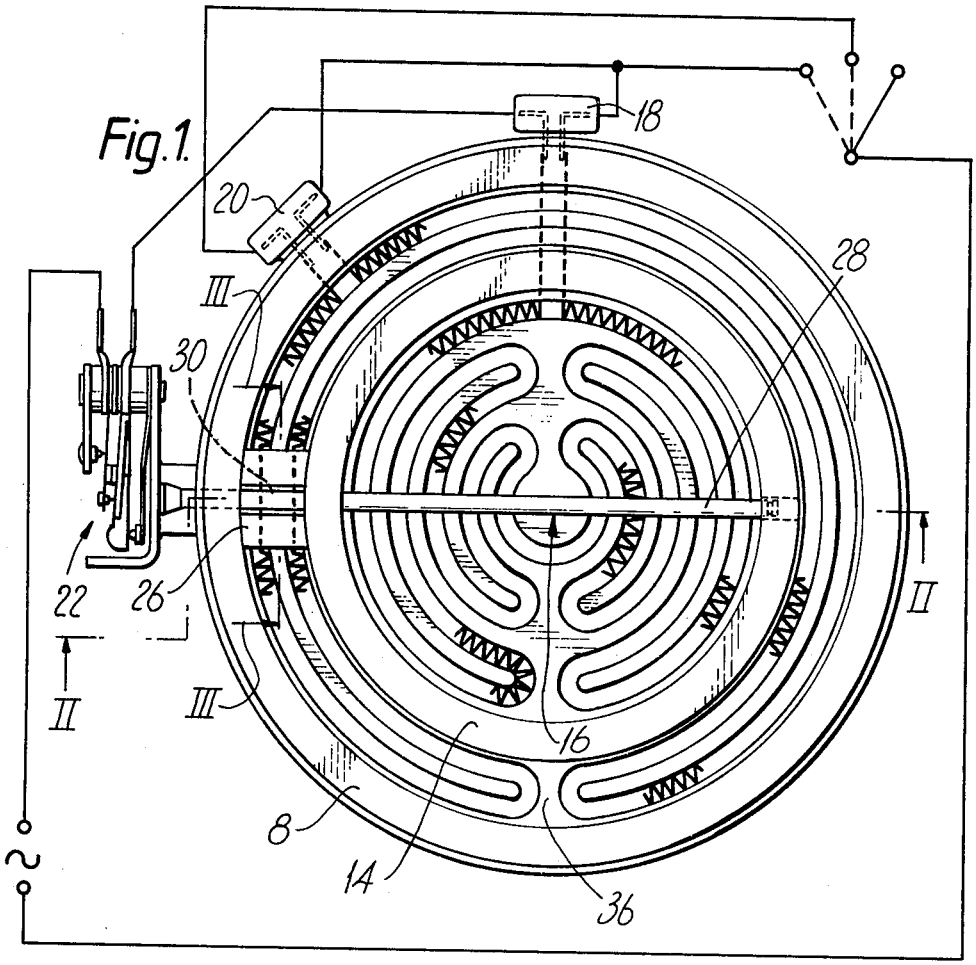
FIG. 1 is a plan view of a heater according to the invention.
Figure 2:
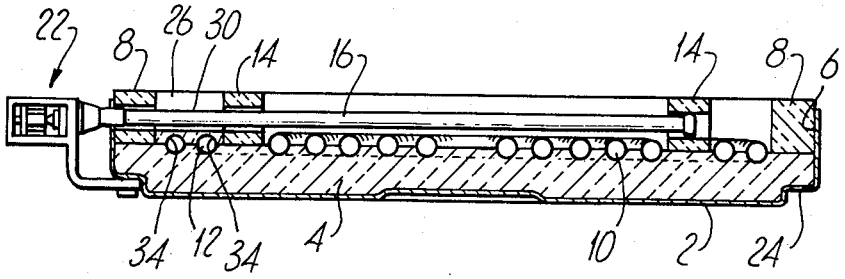
FIG. 2 is a section taken on the line II—II of FIG. 1.

The heater unit illustrated in FIGS. 1 and 2 comprises a metal dish 2 containing a base 4 of electrical and thermal insulating material. Against the side 6 of the dish is located a peripheral wall 8 of thermal insulation. Set in grooves formed in the base 4 are two electric heater coils 10 and 12 which are separated from each other by a dividing wall 14. Extending over the larger coil 10 is a thermal cut-out device 16 which is operable to switch off both coils in the event of overheating.

Each coil is controllable independently through terminal connectors 18 and 20 enabling a circular pan or utensil to be heated solely by the coil 10 and a larger possibly oval casserole or similar utensil be heated on both. Typically, the coil 10 is a 1400 watt unit while the coil 12 is an 800 watt unit. Each coil is unprotected and secured in the base 4 by means of staples (not shown). Each coil is preferably made from an iron chromium aluminium resistance heating wire.

The thermal cut-out device is of the differential expansion type and comprises a quartz tube 28 containing a length of Inconel wire (not shown in FIGS. 1 and 2), differential expansion as a consequence of overheating operating a mechanical switch 22 to disconnect both coils 10 and 12 from the power source. The thermal cut-out device need only be located over the primary coil but to be reliably effective, it must be thermally isolated from the secondary coil 12. To achieve this a portion 30 of the thermal cut-out device 16 is shielded by a block 26 of thermal insulation where it extends over the secondary coil 12 between the peripheral wall 8 and the dividing wall 14. The thermal cut-out device 16 terminates in the dividing wall on the other side of the primary coil 10.

It will be appreciated that the principle of using two separated and independently operable heating coils in a radiant heater of the kind described herein can be extended to all shapes of heater. The circular unit illustrated herein provides a heater having two different circular heating zones definable but the same principle may be applied to square or rectangular heaters. On a smooth top cooker however, where the top is substantially thermally non-conductive it is advantageous to provide a dividing wall of thermal insulating material such as 14 in FIG. 1, to define distinct and separate heating zones. The dividing wall 14 is circular and divides the heating area defined by the peripheral wall 8 into a central and an annular zone. Without a dividing wall, heat radiating from each coil would extend beyond the surface of the top immediately above it with consequent wastage of heat.

Figure 3:
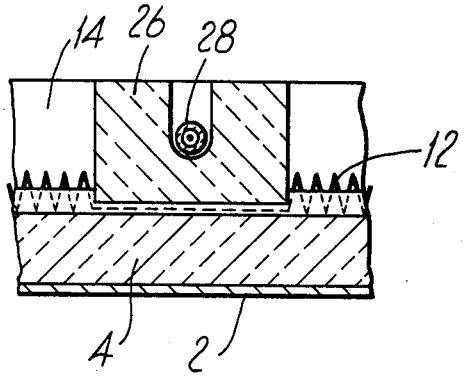
FIG. 3 is a detail section, to a larger scale, taken on the line III—III of FIG. 1.

As shown in FIGS. 1 to 3, the block 26 of insulation material is shaped to rest on the secondary coil 12 and receive the quartz tube 28 of the thermal cut-out device 16. Its height is such as to reach substantially the same level as the peripheral wall 8 and dividing wall 14 such that all may engage the under surface of the smooth top when the unit is installed in a cooker. The block 26 may be formed with channels 34 (as shown in FIG. 2) in its under surface, to allow passage of the coil 12 therethrough or alternatively the coil 12 may be straightened, as shown in FIG. 3 to pass directly under the bulk of the block 26. This has the advantage of reducing the heat generated by the coil 12 in the vicinity of the thermal cut-out device 16 and minimizing energy wastage. In another alternative, the device may be located to extend over the gap 36 between the points of maximum curvature of the coil 12, thereby foregoing any necessity of the coil 12 bypassing the thermal cut-out device 16.

If desired, the block 26 might totally envelope the quartz 28 but we have found that this is not absolutely necessary to achieve satisfactory results. The material of the block 26 may be a ceramic fibre or a microporous insulation material, a preferred example of the latter being that marketed by Micropore International Limited under the Trade Mark MICROTHERM.

Figure 4:
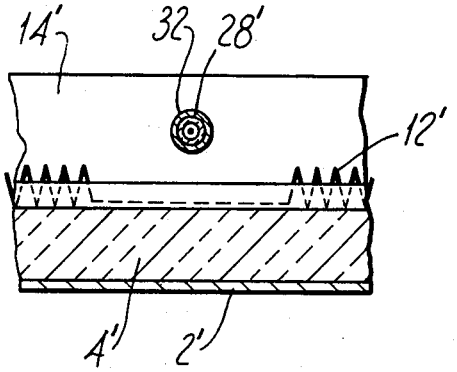
FIG. 4 is a view similar to that of FIG. 3, showing an alternative means by which the cut-out device may be thermally isolated.

FIG. 4 illustrates an alternative means by which the portion 30 of the thermal cut-out device 16 may be thermally isolated. In the preferred embodiment shown in FIG. 4, a quartz tube 28' is enclosed in a tube 32 of thermally conductive material, preferably a metal such as copper. The tube 32 can extend through the peripheral wall 8 to connect with the dish 2, transmitting heat thereto which will be dissipated around the body of the unit. The shape of the tube 32 is not critical; it is its capacity to carry heat away from the secondary coil zone that is important. Once again, and for the reasons given above, a coil 12' may be straightened to pass below the tube 32, or the device 16 located over the gap 36 to minimize the influence of the coil 12' and energy wastage.

The heater illustrated in the drawings has a step junction 24 between the underneath and side of the dish 2 to facilitate mounting of the heater in a cooking appliance. The horizontal flange may be provided with screw holes for securing the heater.

I claim:

1. An electric radiant heater unit comprising:

a heater having at least first and second heater elements located adjacent to one another on a base of electrically and thermally insulating material;

means for providing a power source for said heater;

means for energizing said first heater element independently of said second heater element;

a thermal cut-out device for controllably disconnecting said power source providing means from said heater, which thermal cut-out device extends across said first heater element and across at least a part of said second heater element; and means for thermally insulating said thermal cut-out device from said second heater element whereby said thermal cut-out device is responsive solely to heat emitted by said first heater element.

2. A heater unit according to claim 1, wherein that portion of the thermal cut-out device which extends across said second heater element is shielded from said second heater element by means of a thermal insulation material.

3. A heater unit according to claim 2, wherein said second heater element is in the form of an unprotected coil, a length of said coil being straightened to pass beneath said thermal insulation material and beneath said thermal cut-out device.

4. A heater unit according to claim 2, wherein said thermal insulation material comprises a block of microporous insulation material, the thermal cut-out device being located in a groove formed in said block.

5. A heater according to claim 2, wherein said thermal insulation material comprises a block of ceramic fibre thermal insulation material, the thermal cut-out device being located in a groove formed in said block.

6. A heater unit according to claim 1, wherein that portion of the thermal cut-out device which extends across said second heater element is shielded from said second heater element by means of a thermally conductive material which is connected to a heat sink.

7. A heater unit according to claim 6, wherein the heater unit includes a metal dish which contains the electrically and thermally insulating material on which said first and second heater elements are located, said metal dish constituting the heat sink.

8. A heater unit according to claim 6, wherein the thermally conductive material comprises a metallic tube.

9. A heater unit according to claim 8, wherein the tube is made of copper.

10. A heater unit according to claim 1, wherein said first heater element is circular and said second heater element is annular and substantially surrounds said first heater element.

* * * * *